US006570467B2

(12) United States Patent
Walker et al.

(10) Patent No.: US 6,570,467 B2
(45) Date of Patent: May 27, 2003

(54) COST EFFECTIVE DUAL-MODE SHIFTABLE DIELECTRIC RF FILTER AND DUPLEXER

(75) Inventors: Brian C. Walker, West Lafayette, IN (US); Reddy Vangala, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

(21) Appl. No.: 09/734,957

(22) Filed: Dec. 11, 2000

(65) Prior Publication Data

US 2002/0070820 A1 Jun. 13, 2002

Related U.S. Application Data

(60) Provisional application No. 60/188,101, filed on Mar. 9, 2000.

(51) Int. Cl.[7] ..... H01P 1/213; H01P 1/202
(52) U.S. Cl. ..... 333/134; 333/202; 333/207
(58) Field of Search ..... 333/207, 206, 333/134, 202, 202 DB

(56) References Cited

U.S. PATENT DOCUMENTS

| | | | | |
|---|---|---|---|---|
| 5,055,808 A | | 10/1991 | Walker | 333/207 |
| 5,065,120 A | | 11/1991 | Munn | 333/207 |
| 5,488,335 A | * | 1/1996 | Agahi-Kesheh et al. | 333/206 |
| 5,495,215 A | | 2/1996 | Newell | 333/202 |
| 5,502,422 A | | 3/1996 | Newell | 333/207 |
| 5,515,017 A | * | 5/1996 | Yamada et al. | 333/207 |
| 5,917,387 A | | 6/1999 | Rice | 333/174 |
| 5,963,856 A | | 10/1999 | Kim | 455/307 |

* cited by examiner

*Primary Examiner*—Benny Lee
(74) *Attorney, Agent, or Firm*—Steven Weseman; David K. Lucente

(57) ABSTRACT

An RF signal filter includes an elongate block of dielectric material having a transmit electrode, an antenna electrode and an array of spaced resonators extending between the transmit electrode to the antenna electrode. A signal trap resonator is positioned adjacent to the transmit electrode but opposite the array of spaced resonators. The filter also includes a isolated electrode positioned between but spaced apart from the trap resonator and a local ground conductive layer. A PIN diode switch is operably connected between the isolated electrode and the local ground conductive layer for shifting of the resonant frequency of the trap resonator.

12 Claims, 7 Drawing Sheets

COST EFFECTIVE DUAL-MODE SHIFTABLE DIELECTRIC RF FILTER AND DUPLEXER

This application claims the benefit of Provisional application Ser. No. 60/188,101, filed Mar. 9, 2000.

TECHNICAL FIELD

This invention relates to dielectric block filters for radio-frequency signals, and in particular, to dielectric block resonators suitable for use in filtering signals generated in wireless communication applications.

BACKGROUND

Ceramic block filters offer several advantages over lumped component filters. The blocks are relatively easy to manufacture, rugged, and relatively compact. In the basic ceramic block filter design, the resonators are formed by cylindrical passages, called holes, extending through the block from the long narrow side to the opposite long narrow side. The block is substantially plated with a conductive material (i.e. metallized) on all but one of its six (outer) sides and on the inside walls formed by the resonator holes.

One of the two opposing sides containing holes is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1970s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices (.e.g. handsets) and longer battery life. Combined, these trends place difficult constraints on the design of wireless components such as filters. Filter designers may not simply add more space-taking resonators or allow greater insertion loss in order to provide improved signal rejection.

Therefore, the need continues for improved RF filters which can offer selectivity and other performance improvements, without increases in size or cost of manufacturing. This invention overcomes the size-to-selectivity compromise by providing a ceramic block RF filter having adaptable selectivity with a robust, relatively low cost control mechanism and relatively low insertion loss.

SUMMARY OF INVENTION

An RF signal filter suitable for use in a mobile communication device is provided. The filter includes an elongate block of dielectric material having a transmit electrode and an antenna electrode in the form of selective metallization on the outside surfaces of the block. The dielectric block defines an array of spaced resonators extending between the transmit electrode and the antenna electrode, and a trap resonator adjacent to the transmit electrode but opposite the array of spaced resonators (i.e. at the end of the block nearest the transmit electrode).

The filter also includes a local ground conductive layer on the elongate block, an isolated electrode positioned between but spaced apart from the trap resonator and the local ground conductive layer, and a switch operably connected between the isolated electrode and the local ground conductive layer.

The switch allows shifting of the resonant frequency of the trap resonator by adding a predetermined capacitance of the isolated electrode. In a preferred embodiment, the switch is a PIN diode with a first terminal connected to the isolated electrode and a second terminal connected to the local ground conductive layer. The isolated electrode is adapted for connection to an external input source of DC biasing for switching the PIN diode from a conducting state to a non-conducting state. Alternatively, the isolated electrode is connected through a resistor to the transmit electrode such that a DC bias to the transmit electrode can be used to switch the PIN diode.

Another embodiment of this invention is a dielectric block filter adapted for use as an antenna duplexer. The duplexer comprises an elongate ceramic block which includes an antenna electrode on the elongate ceramic block and a transmitter branch extending between the antenna electrode and a first end of the block, a receiver branch extending between the antenna electrode and a second end of the block. Each branch has a plurality of through-hole resonators.

The ceramic block has a pattern of metallization on the outside surface of the ceramic block. The metallization pattern defines a plurality of connection electrodes including a transmit electrode, a receive electrode, an antenna, and a control electrode. The transmit electrode is spaced apart from the antenna electrode along a length of the block and positioned in the transmitter branch. The receiver electrode is spaced apart from the antenna electrode along the length of the block and positioned in the receiver branch.

At least one of the plurality of resonators of the transmitter branch is a trap resonator which is positioned between the first end of the block and the transmit electrode. An isolated electrode is positioned between but spaced apart from the trap resonator and the local ground conductive layer for creating a capacitive coupling between the trap resonator and the isolated electrode. The filter also includes a PIN diode mounted to the block that has a first terminal connected to the isolated electrode and a second terminal connected to the local ground conductive layer.

The filtering characteristics of dielectric block filters of this invention can be moved from one of two settings by applying and removing a biasing voltage to the control input. Specifically, the effect of the trap resonator on the transfer function of the filter can be shifted between two discrete positions by applying or removing a DC voltage to the control input.

There are other advantages and features of this invention which will be more readily apparent from the following detailed description of the preferred embodiment of the invention, the drawings, and the appended claims.

BRIEF DESCRIPTION OF THE FIGURES

In the FIGURES.

DETAILED DESCRIPTION OF PREFERRED EMBODIMENTS

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Figure 1:
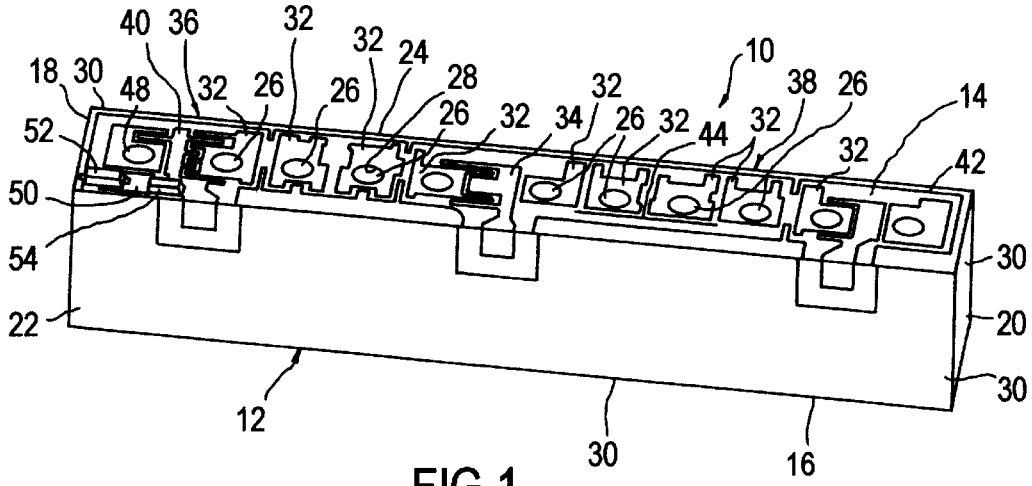
FIG. 1 is an enlarged, perspective view of a block antenna duplexer according to this invention.

Referring to FIG. 1, an antenna duplexer (RF filter) 10 comprises an elongate, box-shaped block of dielectric material 12. Block 12 has an outer surface with six sides, a top surface 14, a bottom surface 16, a first end surface 18, an opposite second end surface 20, and elongate side surface portions 22 and 24. The ceramic filter defines a plurality of resonators. In this preferred embodiment, the resonators take the form of metallized through-holes (or bores) 26 defined in dielectric block 12 from top surface 14 to bottom surface 16. More specifically, the inner side walls 28 which define the through-holes 26 are coated with a contiguous layer of conductive material, i.e. metallized.

The metallization layer (or coating) 30 extends contiguously from within the resonator holes 26 towards both top surface 14 and bottom surface 16. At top surface 14, the extending metallization layer terminates in resonator pads 32, which could also be labeled electrodes. Resonator pads 32 have predetermined capacitances to adjacent resonators and other areas of metallization.

The metallization layer continues from within holes 26 over the bottom surface 16 and about each side surfaces 18, 20, 22 and 24. Accordingly, the continuous metallization layer 30, which is typically a silver-containing material, is applied to substantial portions of bottom surface 16 and side surfaces 18, 20, 22 and 24. This relatively wide-area metallization layer 30 serves as a local ground potential supply and may also be labeled a ground electrode.

For ease of description, duplexer 10 can be divided at antenna electrode (or pad) 34 into two branches of resonators 26, a transmitter branch 36 and a receiver branch 38. Transmitter branch 36 extends between antenna electrode 34 and first end 18, while receiver branch 38 extends in the opposite direction between antenna electrode 34 and second end 20. Each branch includes a plurality of resonators 26 and a respective input/output electrode. More specifically, transmitter branch 36 includes a transmitter electrode 40, and receiver branch 38 includes a receiver electrode 42. Transmitter electrode 40 and receiver electrode 42 are spaced apart from antenna electrode in opposite directions along the length of block 12.

The antenna, transmit and receive electrodes 34, 40, and 42 are defined by metallization patterns on both top surface 14 and side surface 22. These electrodes extend into tabs on the side surface 22 which serve as surface mounting connection points.

Resonator pads 32 and electrodes (34, 40 and 42) and additional features together make up a metallization pattern on top surface 14. Areas of metallization are spaced apart from one another, and are thereby capacitively coupled. The amount of capacitive coupling is roughly related to the size of the metallization areas and the separation distance between adjacent metallized portions as well as the overall block configuration. The metallization pattern on top surface 14 includes an optional metallization strip 44 which reduces insertion loss and improves stop-band signal rejection by coupling a small amount of the RF signal between non-adjacent resonators.

Transmitter branch 36 includes a trap resonator 48. Trap resonators, such as resonator 48, are configured to produce a zero, or attenuation pole, in the transfer function of the filter. To serve as a frequency trap, the resonator is located adjacent transmitter electrode 40 but opposite the array of spaced-apart resonators 26 which extend between antenna electrode 34 and transmitter electrode 40. More specifically, trap resonator 48 is positioned between transmitter electrode 36 and first end 18 of block 12. Pad/electrode 32 of trap resonator 48 has a predetermined capacitance with respect to an isolated electrode 50.

Figure 2:
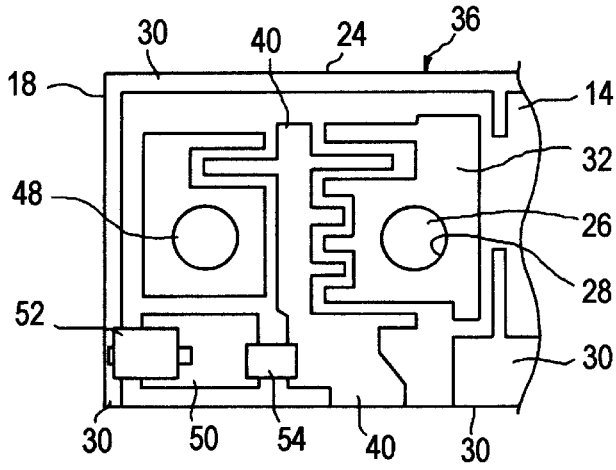
FIG. 2 is a simplified fragmentary top plan view of the input area of the transmitter branch of the duplexer shown in FIG. 1.

Referring now to both FIG. 1 and FIG. 2, adjacent to but spaced apart from trap resonator 48 is an isolated electrode 50. Isolated electrode 50 is positioned between trap resonator 48 and local ground 30. A switch in the form of a PIN diode 52 is connected between local ground 30 and the isolated electrode 50. In a preferred embodiment of this invention the cathode of PIN diode 52 is connected to local ground 30, while the anode of PIN diode 52 is connected to isolated electrode 50. As illustrated in FIGS. 1 and 2, a biasing direct current for controlling PIN diode 52 is preferably provided through transmitter electrode 40. A 2 K Ohms resistor 54 is connected between transmitter electrode 40 and isolated electrode 50 to provide the required switching current to PIN diode 52 when approximately +3 VDC is applied to transmitter electrode 40.

A suitable PIN diode is commercially available from Alpha Industries (Woburn, Mass.) under the designation "SMP 1320-079." Although a PIN diode is preferred for the switching function, other switching mechanisms and switch circuits are contemplated. Other suitable elements which are switchable between discrete connection states include GaAs FET or bipolar transistors. A GaAs FET switch requires very little DC current to cause it to switch between "On" and "Off" states which is advantageous in low power transceiver designs.

In operation, filter 10 provides alternate responses depending upon the state of PIN diode 52. When PIN diode 52 is off, i.e. unbiased or reverse biased, isolated resonator 48 is unconnected to local ground 30 resulting in a relatively higher resonant trap frequency and a wider transmit signal passband. When PIN diode 52 is on (forward, biased), trap resonator 48 is more strongly coupled to local ground layer 30 resulting in a relatively lower resonant trap frequency and corresponding attenuation pole.

Figure 3:
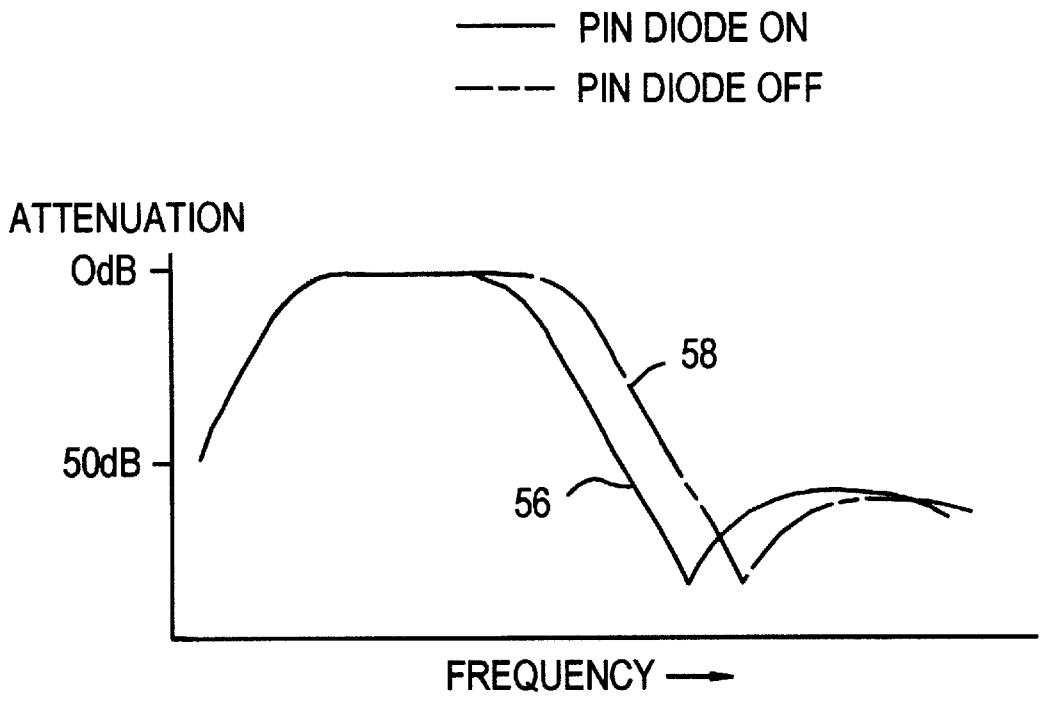
FIG. 3 is a simplified frequency response diagram for an RF filter according to this invention.

FIG. 3 is a generalized transfer function response curve demonstrating the performance of a filter according to this invention. At the high frequency end of the transmitter signal pass band, the filter response can be shifted between curve 56 and curve 58. When PIN diode 52 is off, filter 10 provides a relatively wider pass band with somewhat lesser attenuation of out-of-band signals as exemplified by curve 58. When PIN diode 52 is on, duplex filter 10 provides relatively greater attenuation of out-of-band signals and a somewhat narrower passband as exemplified by curve 56.

Figure 4:
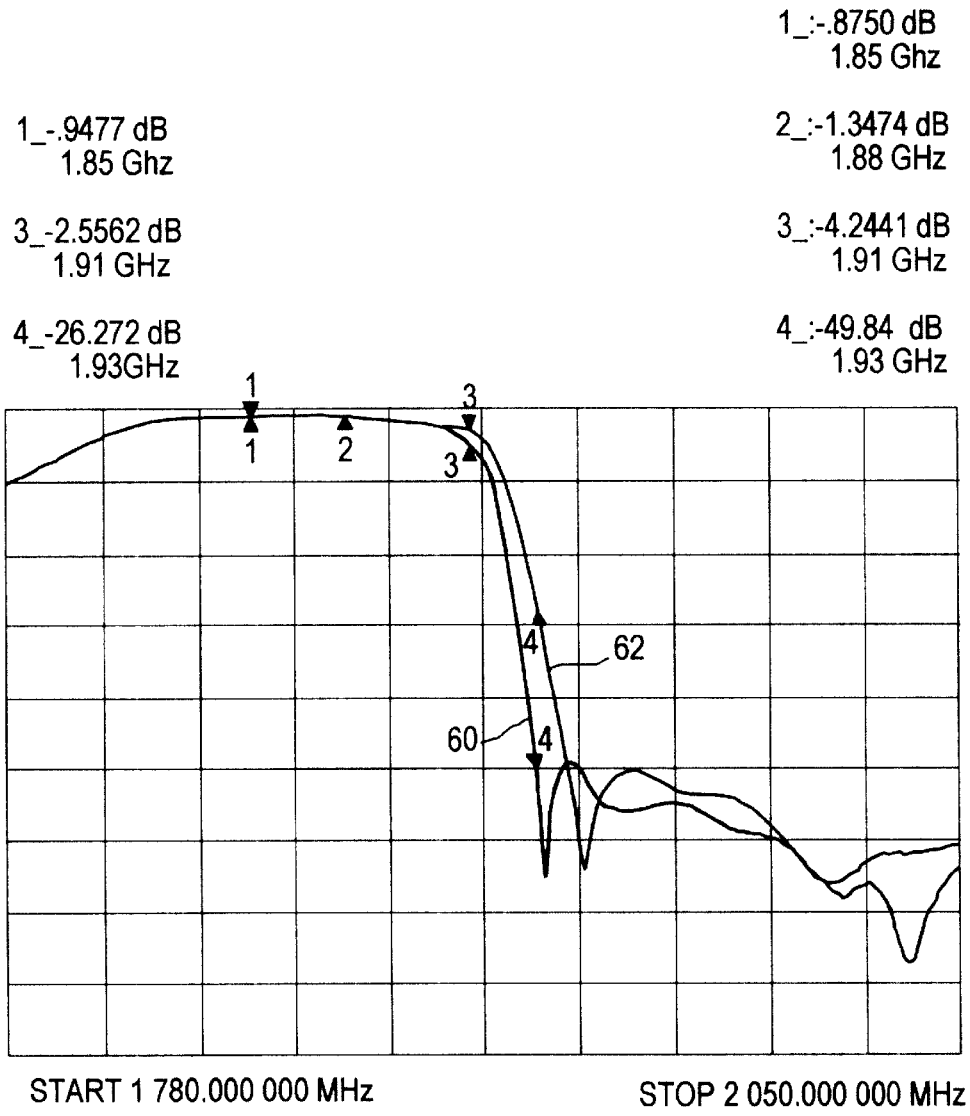
FIG. 4 is a frequency response diagram for an RF filter according to FIG. 1.

FIG. 4 is a transfer function response curve demonstrating the specific performance of a duplex filter according to FIG. 1. Curve 62 was generated with PIN diode 52 switched off and shows a comparatively wider passband. Curve 60 was generated with PIN diode 52 on and shows a relatively narrower passband with correspondingly higher insertion loss for transmit frequency channels at the high end of the passband. Attenuation data for selected frequencies are presented above the graph of FIG. 4. Data (1, 2 and 3) listed at the left side correspond to points on curve 60 identified with downwardly pointing triangles. Data (1, 2, 3 and 4) listed at the right side correspond to points on curve 62 identified with upwardly pointing triangles.

Figure 5:
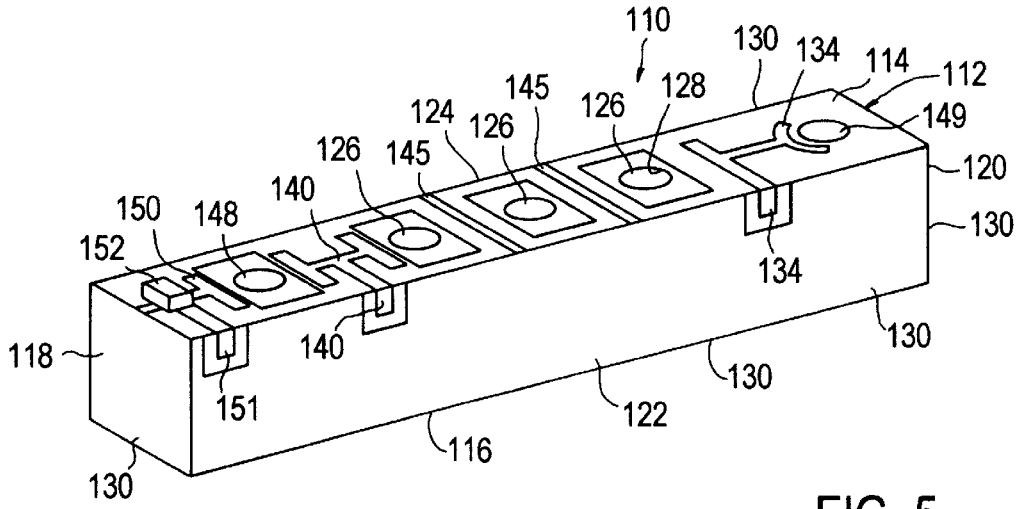
FIG. 5 is an enlarged, perspective view of an RF filter according to this invention.

FIG. 5 shows transmit signal filter 110 suitable for use in a personal communication device. Within FIG. 5, elements similar to those identified in FIG. 1 have been assigned corresponding reference numbers. Filter 110 comprises an elongate, block of dielectric material 112. Block 112 has an outer surface with six sides, a top surface 114, a bottom surface 116, a first end surface 118, an opposite second end surface 120, and elongate side surface portions 122 and 124. Block 112 defines an array of spaced-apart through-hole resonators 126. The through holes extend from openings at top surface 114 though to bottom surface 116. The inner side walls 128 of the through-holes resonators 126 are metallized.

As with filter 10 of FIG. 1, the metallization layer 130 extends contiguously from within the resonator holes 126 towards both top surface 114 and bottom surface 118, where it continues about substantial portions of the side surfaces 118, 120, 122 and 124. Metallization layer 130 serves as an electrode providing a ground potential.

Filter 110 also includes an antenna electrode 134 (or more generically an output electrode) and a transmitter electrode 140, which are defined from the metallization patterns on top surface 114 and side surface 122 of block 112. Transmitter electrode 140 and antenna/output electrode 134 are spaced apart along the length of block 112. The metallization pattern on top surface 114 includes optional transverse strips 145.

An array of resonators 126 extends between transmitter electrode 140 and antenna electrode 134. The through hole resonators 126 are substantially co-linear with each other running in a line of resonators along a length of block 112.

In addition to the array of resonators 126, block 112 defines two signal trap resonator 148 and 149. A transmit trap resonator 148 is located adjacent transmitter electrode 140 but opposite the array of spaced-apart resonators 126 such that trap resonator 148 is positioned between transmitter electrode 140 and first end 118 of block 112. An optional output trap resonator 149 is located adjacent antenna electrode 134 but opposite the array of spaced-apart resonators 126 such that output resonator 149 is positioned between antenna electrode 134 and second end 120.

Adjacent to but spaced apart from trap resonator 148 is an isolated electrode 150. Isolated electrode 150 is positioned between trap resonator 148 and local ground 130. A switch in the form of a PIN diode 152 is connected between local ground 130 and isolated electrode 150. In a preferred embodiment of this invention the cathode of PIN diode 152 is connected to local ground 130, while the anode of PIN diode 152 is connected to isolated electrode 150. As illustrated in FIG. 5, a biasing direct current for controlling PIN diode 152 is provided via an additional control input electrode 151, which like antenna electrode 134 and transmitter electrode 140, includes a tab on side surface 122 for surface mounting or other connection mechanism.

Figure 6:
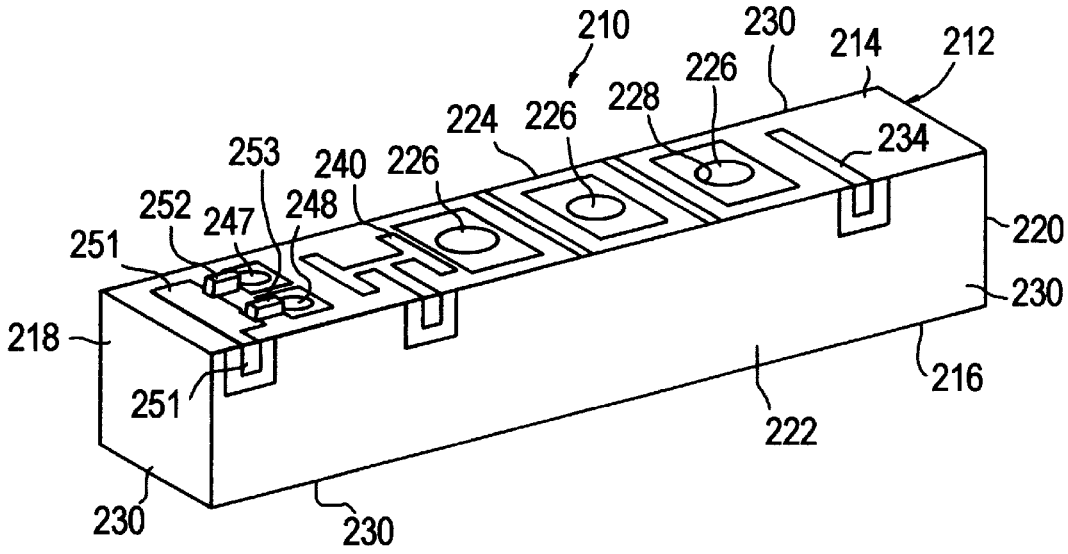
FIG. 6 is an enlarged, perspective view of another RF filter according to this invention.

FIG. 6 depicts another RF signal filter embodying this invention, RF signal filter 210. It includes an elongate ceramic block 212. Block 212 has an outer surface with six sides, a top surface 214, a bottom surface 216, a first end surface 218, an opposite second end surface 220, and elongate side surface portions 222 and 224. Block 212 defines an array of spaced-apart through-hole resonators 226 each with metallized side walls 228.

A relatively large-area metallization layer 230 extends contiguously from side walls 228 about side surfaces 218, 220, 222, 224 and serves as an electrode providing a ground potential.

Metallization electrodes 234 and 240 are spaced apart along a length of block 212 for antenna and transmitter connections, respectively. An array of co-linear resonators 226 extends between transmitter electrode 240 and antenna electrode 234. The through hole resonators 226 are substantially co-linear with each other and parallel to the length of block 212.

Positioned adjacent transmitter electrodes 240 but opposite the array of resonators 226 are two trap resonators 247 and 248. When a plurality of same-side trap resonators are used, the resonators are preferably set out in a line which is not parallel to that of the array of resonators 226. Here, trap resonators 247 and 248 define a line of resonators which is normal to a line defined by the array of resonators 226.

A switching circuit in the form of two PIN diodes 252, 253 and a control electrode 251 controllably interconnects trap resonator 247 and trap resonator 248. A control electrode 251 of metallization area is set on an area of block surface 214 adjacent to but spaced apart from trap resonators 252 and 253. Preferably, control electrode 251 sets between the trap resonators (247 and 248) and local ground 230 at side wall 218.

The cathode of first PIN diode 252 is connected to trap resonator 247, while the anode is connected to isolated electrode 251. The cathode of second PIN diode 253 is connected to resonator 248 while the anode is connected to isolated electrode 251.

With this circuit arrangement, a DC voltage bias applied to control electrode 251 switches on PIN diodes 252 and 253 forming a low-reactance link between trap resonator 247 and 248 which shifts the overall resonant frequency.

Configurations for supplying a DC voltage bias to control electrode 251 may vary according to ultimate application. As presently preferred for this embodiment, control electrode 251 extends to side surface 222 and terminates in an input tab.

Figure 7:
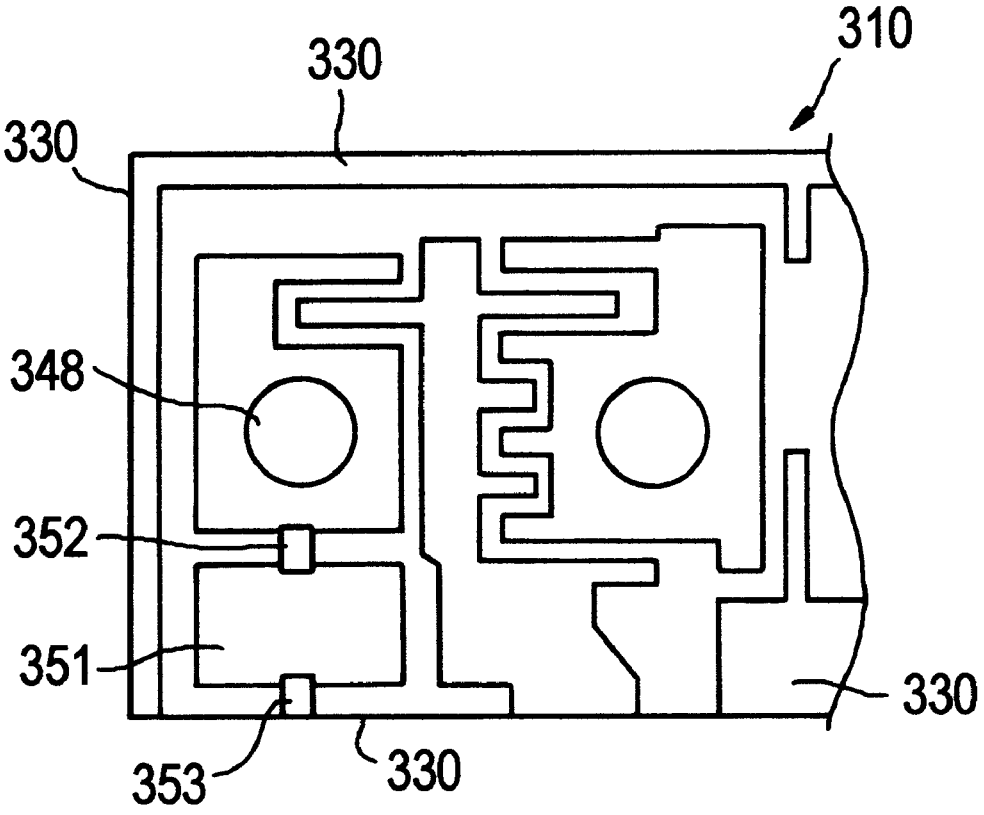
FIG. 7 is a simplified fragmentary top plan view of the transmitter side of a ceramic block filter according to another embodiment of this invention.

FIG. 7 is an enlarged fragmentary view of the transmitter side end portion of a filter 310 according to this invention.

FIG. 7 depicts an alternate circuit arrangement for discretely shifting the resonant frequency of trap resonator 348. The scheme presented in FIG. 7 employs two PIN diodes for controllably connecting the trap resonator to local ground 330. A first PIN diode 352 is connected between trap resonator 348 (to the cathode) and control electrode 351 (to the anode). A second PIN diode 353 is connected between control electrode 351 (to the cathode) and local ground layer 330 (to the anode).

With the circuit arrangement depicted in FIG. 7, a DC voltage bias applied to control electrode 351 switches on PIN diodes 352 and 353 forming a low-reactance link between trap resonator 348 and local ground 330.

All embodiments described above can be applied to an RF signal filter operating at any frequency in the electromagnetic spectrum. Certain possible applications include, but are not limited to, cellular telephones, cellular telephone base stations, and subscriber units. Other possible higher frequency applications include other telecommunication devices such as satellite communications, Global Positioning Satellites (GPS), or other microwave applications. Although the graph in FIG. 4 showed exemplary applications in the range of 0.78 to 2.05 Giga-Hertz, the preferred embodiment of this invention will involve applications in the range of 0.5 to 20 Giga-Hertz.

Dielectric block filters of this invention have several key features. One key feature of this invention is the ability to shift between discrete states of filtering performance without employing complex control circuitry. A second key feature is a robust design approach for manufacturing. Because of the relatively simple control circuitry, dielectric blocks according to this invention have a lower sensitivity to manufacturing variance than heretofore available adjustable block filters.

Figure 8:
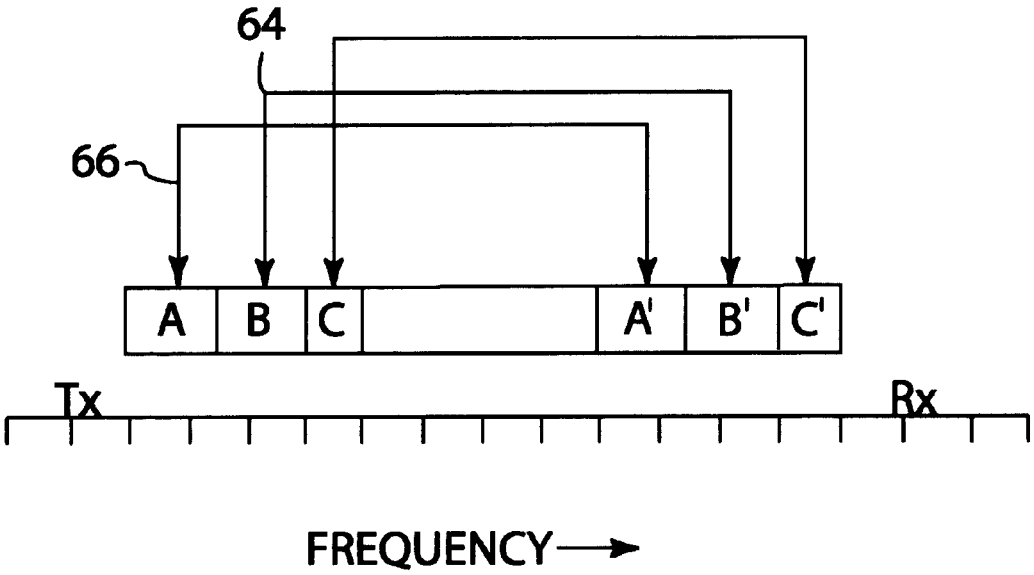
FIG. 8 is a chart showing the frequency allocations for the U.S. PCS standard.

Filters according to the present invention are especially well suited for two-way communication-devices used under PCS or other frequency allocation standards in which Rx (receive) and Tx (transmit) signals are in separate bands of multiple channels as shown in FIG. 8.

Under such standards, the required level of isolation between the Tx and Rx bands varies according to the allocated channel. With reference to FIG. 8, when higher frequency channel sets 64 (e.g. B, B', C, C') are used, isolation between Tx and Rx bands can be sacrificed in the unused lower frequency channel sets 66 (i.e. A, A') in favor of reduced insertion loss for the Tx signal. When lower frequency channels sets 66 are allocated, Tx to Rx isolation to the unused higher frequency channel sets 64 can be sacrificed in favor or reduced insertion loss to the Tx signal.

RF signal block filters according to the present invention are complimentary to such systems because the filtering performance can be shifted between discrete modes for best performance in the selected "A" or "B" sub-bands. When lower frequency channel sets 66 are allocated to a communication device, RF block filters of this invention can be set to operate in accordance with curve 56 of FIG. 3 such that trap resonator 48, provides improved isolation. When relatively higher frequency channel sets 64 are allocated, the RF block filters can be set to operate as curve 58 of FIG. 3 such that trap resonator 48 provides lower Tx insertion loss with high Tx-Rx band isolation in the higher sub-band.

Numerous variations and modifications of the embodiments described above may be effected without departing from the spirit and scope of the novel features of the invention. It is to be understood that no limitations with respect to the specific system illustrated herein are intended or should be inferred. It is, of course, intended to cover by the appended claims all such modifications as fall within the scope of the claims.

We claim:

1. An RF signal filter suitable for use in a mobile communication device, the filter comprising:

an elongate block of dielectric material having a transmit electrode and an antenna electrode, and defining an array of spaced resonators extending from the a transmit electrode to the antenna electrode, the elongate block further defining a trap resonator positioned adjacent to the transmit electrode but opposite the array of spaced through hole resonators;

a local ground conductive layer on the elongate block; and a switch circuit connected between the trap resonator and the local ground conductive layer for opening and closing a relatively low reactance link between the trap resonator and the local ground conductive layer, in which the relatively low reactance link includes a control electrode, a first PIN diode and a second PIN diode, the first PIN diode having a cathode connected to the trap resonator and an anode connected to the control electrode, the second PIN diode having a cathode connected to the local ground conductive layer and an anode connected to the control electrode.

2. The RF signal filter of claim 1 wherein the control electrode is adapted for connection to an input source of DC biasing for switching the first and second PIN diodes from a conducting state to a non-conducting state.

3. An antenna duplexer comprising an elongate ceramic block which includes:

an antenna electrode on the elongate ceramic block;

a transmitter branch extending between the antenna electrode and a first end of the block;

a receiver branch extending between the antenna electrode and a second end of the block;

each branch having a plurality of through-hole resonators;

a local ground conductive layer on the elongate block;

a transmit electrode spaced apart from the antenna electrode along a length of the block and positioned in the transmitter branch;

a receiver electrode spaced apart from the antenna electrode along the length of the block and positioned in the receiver branch;.

at least one of the plurality of resonators of the transmitter branch being a trap resonator which is positioned between the first end of the block and the transmit electrode;

an isolated electrode positioned between but spaced apart from the trap resonator and the local ground conductive layer for creating a capacitive coupling between the trap resonator and the isolated electrode; and a PIN diode having a first terminal and a second terminal, the first terminal being connected to the isolated electrode and the second terminal being connected to the local ground conductive layer, wherein a resistor is connected between the isolated electrode and the transmit electrode thereby allowing the transmit electrode to serve as a connection point for a source of DC biasing for switching the PIN diode from a conducting state to a non-conducting state.

4. The ceramic block RF filter of claim 3 wherein each branch includes at least two resonators.

5. An RF signal filter suitable for use in a mobile communication device, the filter comprising:

an elongate block of dielectric material having a transmit electrode and an antenna electrode spaced apart along the length of the block, and defining an array of co-linear through-hole resonators extending between the antenna electrode and the transmit electrode;

the elongate block further defining a plurality of trap resonators positioned adjacent the transmit electrode but opposite the array of spaced resonators; and a switch for opening and closing a circuit that electrically links together each of the plurality of trap resonators.

6. The RF signal filter of claim 5 wherein the the plurality of trap resonators includes first and second trap resonators and the switch comprises a control electrode and first and second PIN diodes, the first PIN diode having a cathode connected to the first trap resonator and an anode connected to the control electrode, the second PIN diode having a cathode connected to the second trap resonator and an anode connected to the control electrode.

7. The RF signal of claim 5 wherein the array of resonators define a first line of resonators substantially parallel to the length of the elongate block and wherein the plurality of trap resonators define a line of resonators substantially normal to the first line.

8. An RF signal filter suitable for use in a mobile communication device, the filter comprising:

an elongate block of dielectric material having a transmit electrode and an antenna electrode, and defining an array of spaced-apart resonators extending from the transmit electrode to the antenna electrode, the elongate block further defining a trap resonator positioned adjacent to the transmit electrode but opposite the array of spaced resonators;

a local ground conductive layer on the elongate block;

an isolated electrode positioned between but spaced apart from the trap resonator and the local ground conductive layer for creating a capacitive coupling between the trap resonator and the isolated electrode;

a switch operably connected between the isolated electrode and the local ground conductive layer for shifting the resonant frequency of the trap resonator, wherein a resistor is connected between the isolated electrode and the transmit electrode thereby allowing the transmit electrode to serve as an input connection for a source of DC biasing for switching the PIN diode from a conducting state to a non-conducting state.

9. The RF signal filter of claim 8 wherein the array of spaced resonators includes two resonators.

10. The RF signal filter of claim 8 wherein the elongate block further defines a second array of spaced resonators extending away from the antenna electrode in a direction opposite the transmit electrode and wherein the elongate block further includes a receive electrode positioned such that the second array of spaced resonators extends from the antenna electrode to the receive electrode.

11. The RF signal filter of claim 10 wherein the second array of spaced resonators includes at least two through-hole resonators.

12. An RF signal filter suitable for use in a mobile communication device, the filter comprising:

an elongate block of dielectric material having a transmit electrode and an antenna electrode, and defining an array of spaced resonators extending from the transmit electrode to the antenna electrode, the elongate block further defining a trap resonator positioned adjacent to the transmit electrode but opposite the array of spaced through-hole resonators;

a local ground conductive layer on the elongate block; and a switch circuit connected between the trap resonator and the local ground conductive layer for opening and closing a relatively low reactance link between the trap resonator and the local ground conductive layer, in which the relatively low reactance link includes a control input electrode, a PIN diode and a capacitor, the PIN diode having a cathode connected to the trap resonator and an anode connected to the control input electrode, the capacitor being connected between the local ground conductive layer and the control input electrode.

* * * * *